US006968039B2

(12) United States Patent
Lemaitre et al.

(10) Patent No.: US 6,968,039 B2
(45) Date of Patent: Nov. 22, 2005

(54) FOCAL SPOT POSITION ADJUSTMENT SYSTEM FOR AN IMAGING TUBE

(75) Inventors: Sergio Lemaitre, Whitefish Bay, WI (US); John Scott Price, Wauwatosa, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 0 days.

(21) Appl. No.: 10/604,605

(22) Filed: Aug. 4, 2003

(65) Prior Publication Data

US 2005/0029957 A1 Feb. 10, 2005

(51) Int. Cl.[7] ..... H01J 35/14

(52) U.S. Cl. ..... 378/138; 378/136; 378/121; 378/140

(58) Field of Search ..... 378/19, 20, 125, 378/129, 113, 143, 136–138, 119, 140; 315/169, 315/169.4

(56) References Cited

U.S. PATENT DOCUMENTS 5,125,019 A 6/1992 Evain et al. ..... 378/137
6,236,713 B1 5/2001 True et al. ..... 378/138
6,438,207 B1 8/2002 Chidester et al. ..... 378/138
2003/0223538 A1 * 12/2003 Bani-Hashemi et al. ..... 378/65

* cited by examiner

*Primary Examiner*—Tuyet Thi Vo
(74) *Attorney, Agent, or Firm*—Peter J. Vogel; Artz & Artz, P.C.

(57) ABSTRACT

A cathode (38) for an imaging tube (33) is provided. The cathode (38) includes an emitter (74) that emits an electron beam (98) to a focal spot (46) on an anode (44). A backing member (76) is electrically disposed on a second side (78) of the emitter (74) and contributes in formation of the electron beam (98). A deflection electrode (82) is electrically disposed between the backing member (76) and the anode (44) and adjusts position of the focal spot (46) on the anode (44). A non-contact x-ray source component position measuring system (32) is also provided. The position measuring system (32) includes an electromagnetic source (18) having an electromagnetic radiation source component (42) and a probe (50) that directs an emission signal (52) at and receives a return signal from the electromagnetic radiation source component (42). A controller (28) generates the emission signal (52) and determines position of the electromagnetic radiation source component (42) in response to the return signal (54). An electron beam focal spot position adjusting system (12) is also provided.

19 Claims, 4 Drawing Sheets

FOCAL SPOT POSITION ADJUSTMENT SYSTEM FOR AN IMAGING TUBE

CROSS REFERENCE TO RELATED APPLICATIONS

The present invention is related to U.S. patent application Ser. No. 10/604,606, filed Jul. 30, 2002, entitled "CATHODE FOR HIGH EMISSION X-RAY TUBE" incorporated by reference herein.

BACKGROUND OF INVENTION

The present invention relates generally to x-ray imaging systems. More particularly, the present invention relates to systems and methods of adjusting focal spot positioning relative to a target within an imaging tube.

Traditional x-ray imaging systems include an x-ray source and a detector array. X-rays are generated by the x-ray source, pass through an object, and are detected by the detector array. Electrical signals generated by the detector array are conditioned to reconstruct an x-ray image of the object.

Computed tomography (CT) imaging systems include a gantry that rotates at various speeds in order to create a 360° image. The gantry contains a CT tube assembly that generates x-rays across a vacuum gap between a cathode and an anode. In order to generate the x-rays, a large voltage potential of approximately 150 kV is created across the vacuum gap allowing electrons, in the form of an electron beam, to be emitted from the cathode to the target portion of the anode. In the releasing of the electrons, a filament contained within the cathode is heated to incandescence by passing an electric current therein. The electrons are accelerated by the high voltage potential and impinge on the target at a focal spot, whereby they are abruptly slowed down, directed at an impingement angle $\alpha$ of approximately 90°, to emit x-rays through a CT tube window.

The cathode or electron source is typically a coiled tungsten wire that is heated to temperatures approaching 2600° C. The electrons are accelerated by an electric field imposed between the cathode and the anode. The anode, in a high power x-ray tube designed for current CT devices, is a tungsten target having a target face, that rotates at angular velocities of approximately 120 Hz or greater.

The focal spot has an associated location on a surface of the anode. The location of the focal spot, with respect to the gantry and CT detector assembly, is dependent upon the position of the target face with respect to an insert frame of the imaging tube, which is fixed to an outer frame or casing of the tube. The temperature of different elements of the anode, such as an anode rotor, stem, bearing, stud, hub, and thermal barrier, determine z-direction position of the target face, along an axis of rotation of the anode.

The focal spot location is controllably translated within the x-ray imaging tube in order to perform a double sampling technique. The double sampling technique is utilized to prevent aliasing effects in image reconstruction. It is desirable to prevent aliasing in order to generate quality images with minimum artifacts in x-ray imaging.

Double sampling refers to a sampling frequency of at least 2/a, where "a" is a third generation computed tomography (CT) scanner sampling distance of a scanned field. Sample frequency for the CT scanner is equal to 1/a, which is half the preferred Nyquist theorem sampling frequency of at least 2/a. Double sampling can be achieved by numerically evaluating two images. A first image is acquired with the detector in a default position and a second image is acquired after moving the detector by a distance of a/2 normal to the incident x-rays while maintaining position of the x-ray source. Equivalently, the two images needed for double sampling can also be obtained by laterally moving the focal spot between two exposures a distance that causes the subsequent x-ray image to move a distance of a/2 on the detector.

Double sampling is accomplished in conventional imaging systems by adjusting focal spot positioning on the target or surface of the anode, electronically without mechanical motion, via use of deflection coils or plates within an x-ray tube. The deflection coils and plates deflect an electron beam either by creating a local magnetic or electrostatic field.

A method of performing double sampling of each beam is to wobble an x-ray source or imaging tube by an amount that shifts each beam by one-half the space between the beams. Wobbling is mechanically equivalent to taking a second set of projections with the detector shifted to some odd multiple of one-half pitch of the detector. The detector is allowed to naturally rotate to a one-half pitch position while the x-ray source is repositioned, along a circumferential path of rotation of the source, back to a position where a first projection set of data was collected. Wobbling is generally within a plane of rotation of the gantry and along a tangent to the gantry rotation.

Wobbling may be performed by acquiring a first set of data with a focal spot in a first position on a first 360° scan and acquiring a second set of data with the focal spot shifted to a second position on a second 360° scan. Preferably, however, to avoid motion problems between adjacent samples, the x-ray beam is rapidly shifted between positions and each projection.

Due to limited amounts of available space within an imaging tube utilization of the deflection coils and plates is not feasible. The close proximity and the high voltage potential between the cathode and the anode render the deflection coils and plates impracticable.

Externally generated magnetic fields have been suggested for focal spot position adjustment and wobbling, which would allow use of current cathode/anode designs. However, in order to generate the magnetic fields, external components are required, which considerably increases weight of the imaging tube. Increase in weight limits feasible rotating speeds of CT imaging systems due to increases in loads experienced by gantry components. The increased loads degrade CT imaging tube performance.

It would therefore be desirable to provide a focal spot position adjusting system that is applicable to CT imaging, that is electronic, does not significantly increase weight of or occupy increased space within an imaging tube, and does not require use of deflection coils or plates.

Thermally induced growth of anode elements with increase in temperature is referred to as z-thermal. Z-thermal is tracked by various methods. Z-thermal is typically determined by estimating the position of the target face by calibrating a measured focal spot position with respect to power or total heat deposited in the target. Cool-down times are recorded and estimates can be made on focal spot positions, during operation, even after extended periods of not using the CT system. A CT device back-projection algorithm introduces corrections for focal spot motion since final image artifacts depend upon differences between a real focal spot location and an estimated focal spot location.

Target face position estimating can be inaccurate. Actual focal spot positioning can drift over time due to temperature changes in various components, amount and type of use of the components, whether a component is new or aged, system operating power level, system operating time, and other focal spot position affecting factors known in the art.

Another disadvantage with existing focal spot estimation is different CT x-ray tube designs require different focal spot motion calibration schemes, which must be developed, tested, and performed for each tube type and potentially for each design revision within a tube type. The calibration schemes are costly to implement, time consuming, and are potentially inaccurate since multiple anode behaviors occur with a specified anode temperature.

It is therefore also desirable to provide a system for accurately determining actual focal spot positioning.

SUMMARY OF INVENTION

The present invention provides a system and method of adjusting focal spot positioning relative to a target within an imaging tube. A cathode for an imaging tube is provided. The cathode includes an emitter that emits an electron beam to a focal spot on an anode. A backing member is electrically disposed on a second side of the emitter and contributes in formation of the electron beam. A deflection electrode is electrically disposed between the backing member and the anode and adjusts position of the focal spot on the anode. A method of operating an x-ray source containing the cathode is provided.

A non-contact x-ray source component position measuring system is also provided. The position measuring system includes an electromagnetic source having an electromagnetic radiation source component and a probe that directs an emission signal at and receives a return signal from the surface of the anode. A controller generates the emission signal and determines position of the x-ray source component in response to the return signal. A method of performing the same is also provided. Additionally, an electron beam focal spot position adjusting system is provided, including the cathode and the x-ray source component position measuring system.

One of several advantages of the present invention is that it provides ability to deflect the x-ray source electronically without motion of mechanical componentry and at the same time it does not occupy any more space than a conventional cathode. Thus, the present invention allows minimizing system complexity, weight of an imaging tube assembly, space consumption, and potential costs involved in maintaining system components.

Another advantage of the present invention is that it provides an accurate non-contact measuring system for determining position of an anode within an imaging tube. Thereby, increasing accuracy of focal spot position determination and increased quality of image reconstruction.

Furthermore, the present invention provides a system for accurately adjusting focal spot positioning and in so doing minimizing artifacts and increasing image quality.

Moreover, the present invention provides quick current modulation of electron emission. Thus, the present invention accounts for varying thickness and material density of a patient, limits x-ray dosage of the patient, and further improves image quality.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein:

FIG. 5 is a perspective view of a cathode in accordance with another embodiment of the present invention; and.

DETAILED DESCRIPTION

Figure 1:
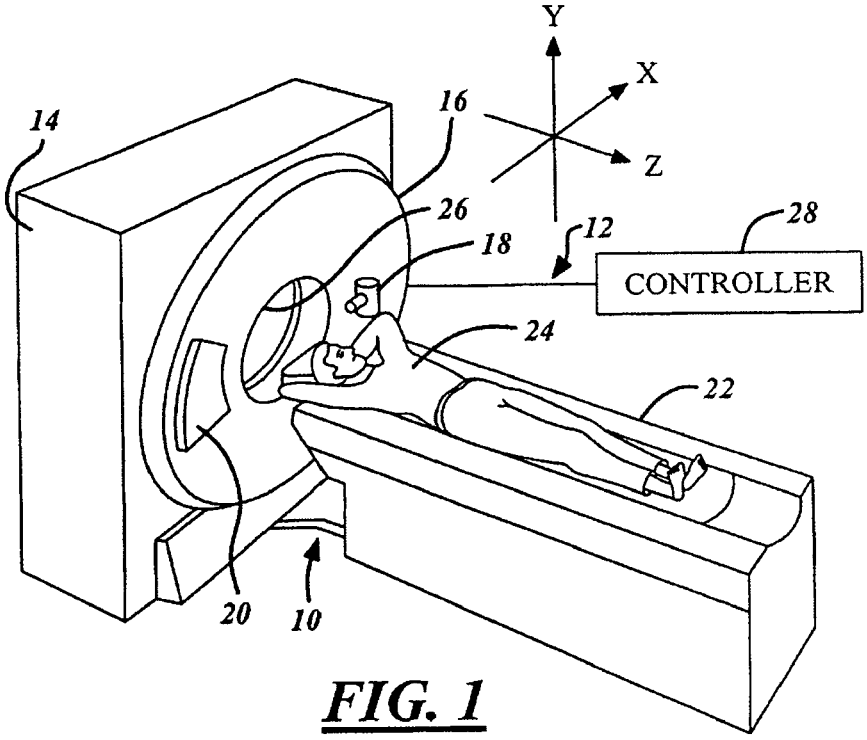
FIG. 1 is a perspective and diagrammatic view of a computed tomography (CT) imaging system including an electron beam focal spot position adjusting system in accordance with an embodiment of the present invention.

In each of the following figures, the same reference numerals are used to refer to the same components. While the present invention is described with respect to a system and methods of adjusting focal spot positioning relative to a target within an imaging tube, the following system and methods are capable of being adapted for various purposes and are not limited to the following applications: computed tomography (CT) systems, radiotherapy systems, X-ray imaging systems, nuclear imaging systems, and other applications known in the art.

Also, the present invention although described as being used in conjunction with a CT tube may be used in conjunction with other imaging tubes including cardiac x-ray tubes and angiography x-ray tubes.

In the following description, various operating parameters and components are described for one constructed embodiment. These specific parameters and components are included as examples and are not meant to be limiting.

Referring now to FIG. 1, a perspective and diagrammatic view of a CT imaging system 10 including an electron beam focal spot position adjusting system 12 in accordance with an embodiment of the present invention is shown. The imaging system 10 includes a gantry 14 that has a rotating inner portion 16 containing an electromagnetic source 18 and a detector array 20. The source 18 projects a beam of x-rays towards the detector array 20. The source 18 and the detector array 20 rotate about an operably translatable table 22. The table 22 is translated along a z-axis between the source 18 and the detector array 20 to perform a helical scan. The beam after passing through a medical patient 24, within a patient bore 26 is detected at the detector array 20 to generate projection data that is used to create a CT image. The focal spot adjusting system 12 includes the source 18 and a controller 28, which are described in further detail below.

Figure 2:
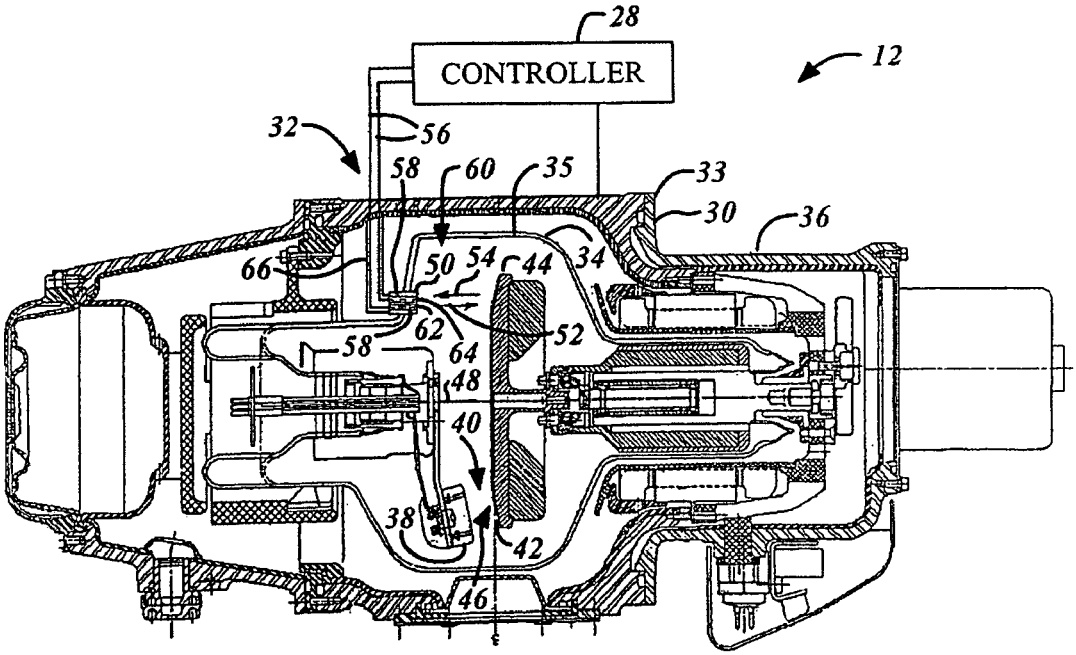
FIG. 2 is a cross-sectional view of a CT tube assembly including a non-contact x-ray source component position measuring system in accordance with an embodiment of the present invention.

Referring now to FIG. 2, a cross-sectional view of a CT tube assembly 30 including the focal spot adjusting system 12 and a non-contact electromagnetic source component position measuring system 32 in accordance with an embodiment of the present invention is shown. The assembly 30 is located within the source 18 and includes an imaging tube 33 having an insert 34. The insert 34 has an insert wall 35 that is within a CT tube housing or casing 36. A cathode 38 generates and emits electrons across a vacuum gap 40 in the form of an electron beam, which is directed at a target 42 on a rotating anode 44 creating a focal spot 46. The anode 44 rotates about a center axis 48.

The position measuring system 32 includes the CT tube assembly 30 having a probe 50 directing an emission signal 52 at and receiving a return signal 54 from the target 42 for determining position of the target 42 relative to the casing 36. The emission signal and the return signal are in the form of electromagnetic radiation such as visible light, infrared, ultraviolet, radio, or other radiation known in the art. Of course, the probe 50 may be directed at and used to determine positioning of other electromagnetic radiation source components. The controller 28 is electrically coupled to the probe 50 and generates the emission signal 52 and determines position of the target 42 in response to the return signal 54 using distance measuring techniques known in the art, such as interferometry or time-of-flight techniques.

In using interferometry to determine distance the emission signal 52 needs to have an incident wave with a wave front that is fairly uniform at a point of origin. As the wave front is reflected from the target it is added with a portion of additionally generated wave fronts, and interference between the originally generated wave fronts and the reflected wave fronts is evaluated for evidence of constructive, partially constructive or destructive interference. In using time-of-flight to determine distance, the emission signal 52 is modulated, timed, and delay between transmission of the emission signal 52 and reception of the return signal 54 indicates distance that the emission signal 52 traversed divided by speed of propagation of the emission signal 52. Time-of-flight does not require a preserved wave front and is therefore potentially more accurate than interferometry. Reflectivity of the emission signal 52, in using both interferometry and time-of-flight, is assured in that metals have high reflectivity over a wide range of wavelengths from near ultraviolet to infrared.

The probe 50 is electrically coupled to the controller 28 via a transmission medium 56. The transmission medium 56 maybe in the form of optical conduit and is preferably formed of fused quartz or other similar materials, such as glass or fiber optic materials known in the art, that are capable of withstanding environmental conditions within the tube 33. Fused quartz or the like is preferred due to vacuum integrity of the material, resistance to heat, robustness against radiation damage, deformation and transparence to light having a wide range of wavelengths. Sealing technology is also standard and known in the art for fused quartz and the like. For example, the probe 50 may also include a couple of feedthroughs 58 that allow the transmission medium 56 to penetrate the insert wall 35 into an insert area 60 and seal the probe 50 including a first optical conduit end 62 and a second optical conduit end 64 to the insert wall 35, and prevent vacuum leakage to the atmosphere.

The probe 50 and feedthroughs 58 may be located in various locations within the CT tube assembly 30 and may have various angular relationships with the anode 44. The probe 50 and feedthroughs 58 may be located such that the ends 62 and 64 are positioned opposite to the cathode in relation to the centerline 48 and thus shielded from direct exposure to radiation and the focal spot 46, which is typically the hottest portion of the anode 44.

A hood or extension tube 66 may be utilized to further protect the transmission medium 56. The extension tube 66 may be incorporated as shown encasing the transmission medium 56 between the casing 36 and the probe 50 or may be incorporated as to protect ends 62 and 64. The extension tube 66 may be formed of stainless steel or other similar material known in the art.

The controller 28 is preferably microprocessor based such as a computer having a central processing unit, memory (RAM and/or ROM), and associated input and output buses. The controller 28 may be a portion of a central main control unit or may be a stand-alone controller as shown.

Figure 3:
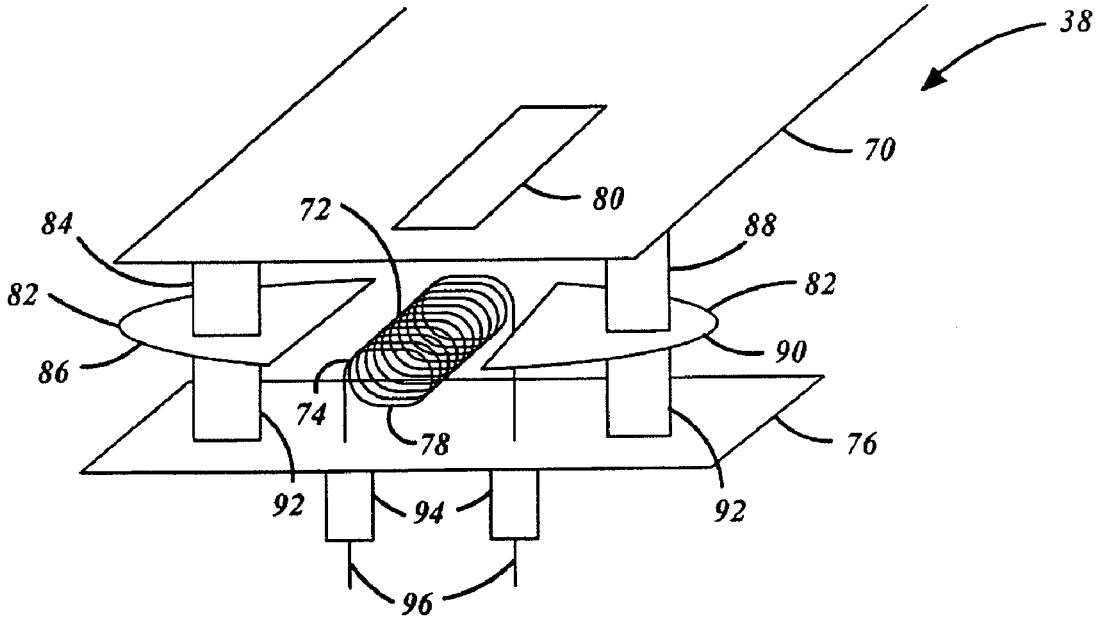
FIG. 3 is a perspective view of a cathode in accordance with an embodiment of the present invention.

Referring now to FIG. 3, a perspective view of the cathode 38 in accordance with an embodiment of the present invention is shown. The cathode 38 may include a front member 70 electrically disposed on a first side 72 of the emitter 74 and includes a backing member 76 electrically disposed on a second side 78 of an emitter 74. The front member 70 has an aperture 80 coupled therein. The emitter 74 emits an electron beam to the focal spot 46. The aperture 80 and the backing member 76 are differentially biased as to shape and focus the beam to the focal spot 46. For further detailed description of the differentially biased functionality of the cathode 38 and the anode 44 see U.S. patent application, attorney docket number 124793. Deflection electrodes 82 are shown as an electrode pair and are electrically disposed between the backing member 76 and the front member 70. The deflection electrodes 82 adjust positioning of the focal spot 46 on the anode 44. Note that the cathode 38, as shown, is symmetrically designed. Symmetrical design of the cathode 38 although desired for simplicity and for electron beam shaping, is not a requirement of the present invention.

The cathode 38 also includes multiple isolators separating the front member 70, the backing member 76, and the deflection electrodes 82. A first side steering electrode insulator 84 may be coupled between the front member 70 and a first side steering electrode 86 and a second side steering electrode insulator 88 may be coupled between the front member 70 and a second side steering electrode 90. The first insulator 84 and the second insulator 88 isolate the deflection electrodes 82 from the front member 70. A pair of backing insulators 92 is coupled between the deflection electrodes 82 and the backing member 76 and isolates the deflection electrodes 82 from the backing member 76. A pair of filament insulators 94 are coupled to emitter electrodes 96 to maintain the emitter 74 at a potential isolated from the backing member 76. Of course, the deflection electrodes 82 and the insulators 84, 86, 88, and 92 may be in various locations and be utilized in various combinations.

Figure 4:
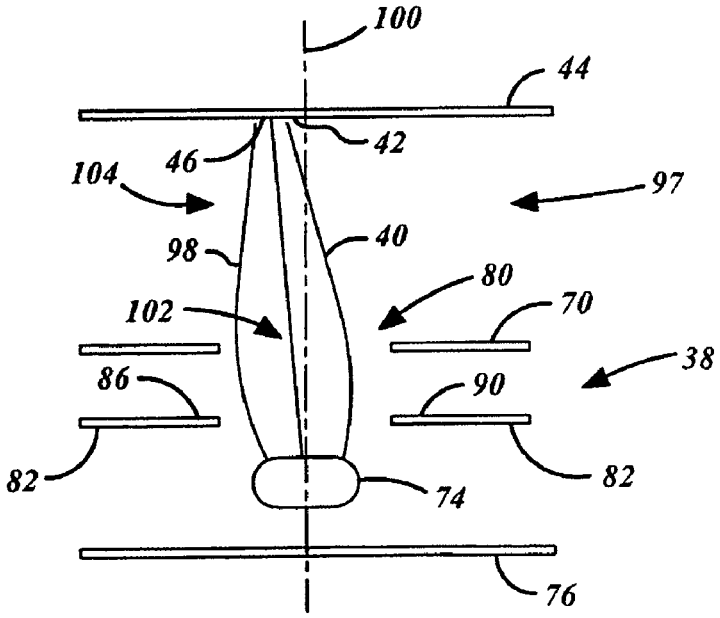
FIG. 4 is a schematic representation of a cathode and an anode illustrating an asymmetrical extracted electron beam in accordance with an embodiment of the present invention.

Referring now to FIG. 4, a schematic representation of the cathode 38 and the anode 44 illustrating an asymmetrical extracted electron beam 40 in accordance with an embodiment of the present invention is shown. The cathode 38 and the anode 44 create a dipole field 97 therebetween. The emitter 74 emits an electron beam 98 through the aperture 80 in the front member 70 to the focal spot 46 on the target 42 across the dipole field 97. The electron beam 98 may be symmetrical to an emitter centerline 100 extending through the emitter 74 and a center 102 of the aperture 80. During focal spot position adjustment, such as during wobbling, the deflection electrodes 82 may be asymmetrically biased to adjust position of the focal spot 46 on the target 42. For example, the deflection electrodes 82 may be asymmetrically biased to shift the focal spot 46 to a left side 104 of the emitter centerline 100, as shown.

The bias voltages applied to the electrodes 82 are dependent on the specific application. When wobbling, the bias voltages of the deflection electrodes 82 are typically less on one side and greater on an opposite side of the electrodes as compared to the bias voltage of the emitter 74. The bias voltages of the deflection electrodes 82 are greater than the bias voltage of the backing member 76. In one embodiment of the present invention, using the above example of shifting the beam 98 to the left, the focal spot 46 is adjusted to the left side 104 of the emitter centerline 100 and using the following voltages; an emitter voltage and a front member voltage approximately equal to 0V, a backing member voltage approximately equal to 6 kV, a first electrode voltage approximately equal to 700V, and a second electrode approximately equal to 300V. Note that the first electrode 86 is positively biased and has a larger bias than the second electrode 90, to shift the electron beam 98 towards the first electrode 86.

Figure 5:
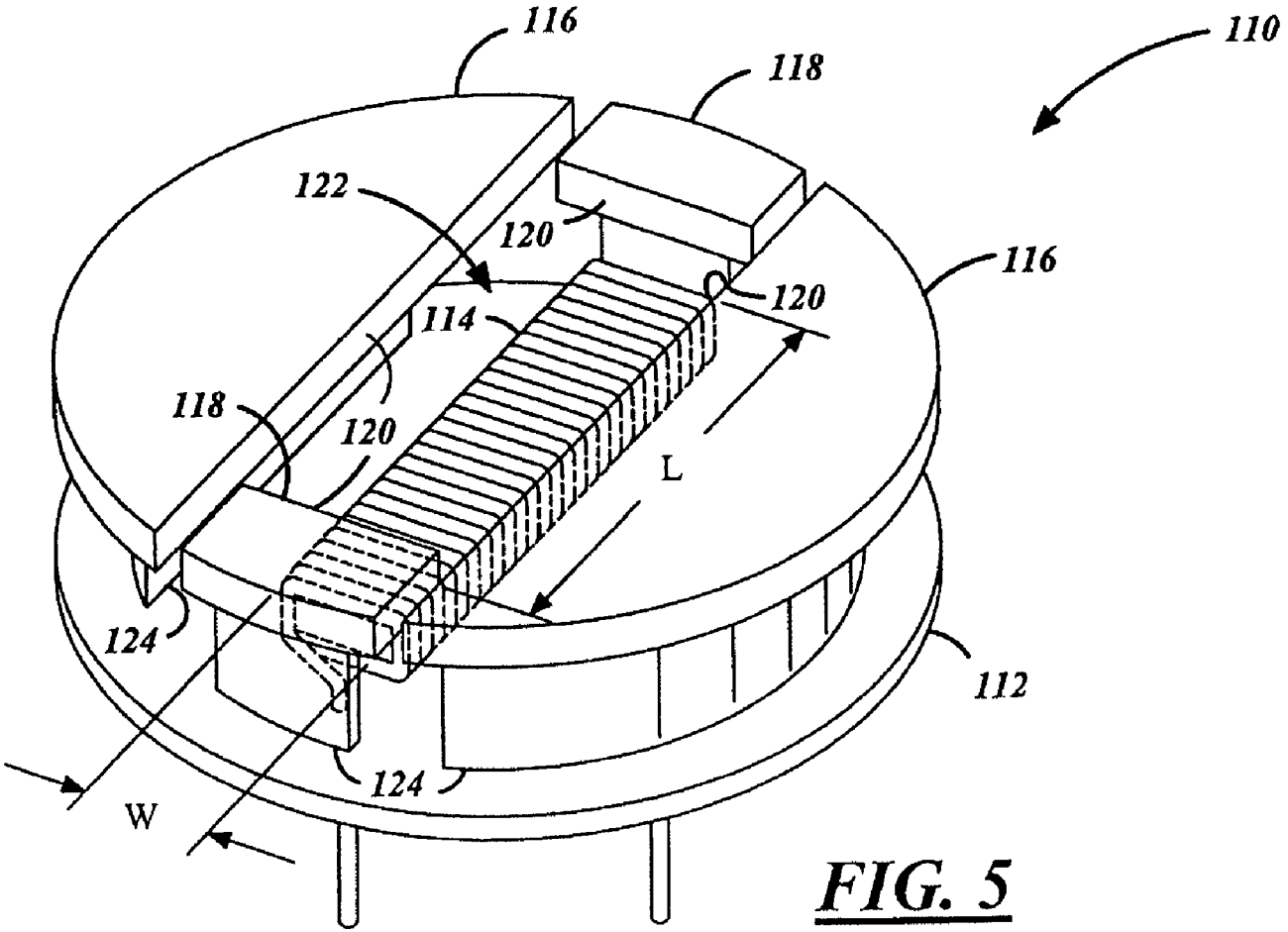

Referring now to FIG. 5, a perspective view of a cathode 110 in accordance with another embodiment of the present invention is shown. Cathode 110, similar to cathode 38, includes a backing member 112 and an emitter 114. A first pair of deflection electrodes 116 extends along length L of the emitter 114. A second pair of deflection electrodes 118 extends along width W of the emitter 114. In adjacent surfaces 120 of the electrode pairs 116 and 118 are at approximately 90° angles with each other. The adjacent surfaces 120 form an electron beam passage area 122. Insulators 124 are disposed between the backing member 112 and the electrode pairs 116 and 118. Note that the cathode 110, unlike cathode 38, does not have a front member; electrode pairs 116 and 118 serve as a front member.

The backing member controls width and length of the focal spot. When differentially biased, i.e. different voltages are applied to each electrode of an electrode pair, the electrode pair 116 deflects the electron beam in the W-direction, such as in double sampling. The electrode pair 118 deflects the electrons in the L-direction. The first electrode pair 116 also adjusts focal spot width and the second pair of electrodes 118 also adjusts focal spot length.

For certain applications the electrode pairs 82, 116, and 118 provide a negative voltage forward of the emitters 72 and 114. The negative voltage reduces the electric fields at emitter surfaces, which provides current or mA modulation. Current modulation refers to adjustment of the amount of electron emission current. Current modulation is achieved through adjusting biasing voltages between the backing member 112 and the electrode pairs 116 and 118, as is similarly performed between the front member 70 and the backing member 76 of cathode 38 above. In providing the negative voltage forward of the emitters 72 and 114, width and length of the focal spots generated by the emitters 72 and 114 are reduced in size. To compensate for the reduction in focal spot width and length or in other words to refocus electron beams generated therefrom the backing members 76 and 112 are operated at a relatively more positive potential relative to the potential needed for an unmodulated beam. In providing sufficiently negative voltage forward of the emitters 72 and 114 the electron flow can be cut off. This is referred to as gridding. Gridding occurs when there exist a negative voltage potential of approximately 4 kV to 7 kV between the front members 70 and the emitters 72 and 114.

Figure 6:
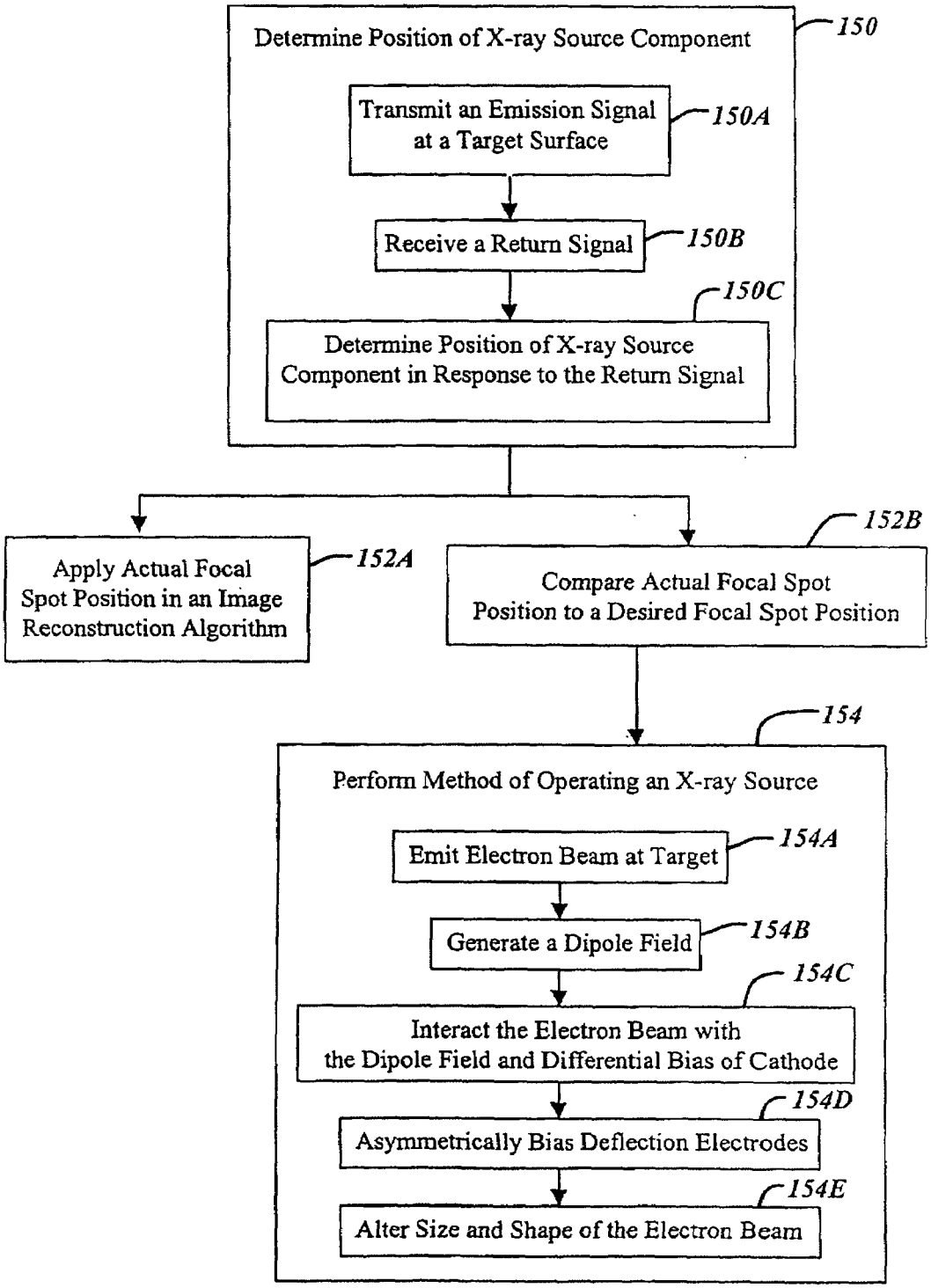
FIG. 6 is a logic flow diagram illustrating a method of adjusting focal spot positioning including a method of determining position of an electromagnetic radiation source component and a method of operating an electromagnetic source in accordance with an embodiment of the present invention.

Referring now to FIG. 6, a logic flow diagram illustrating a method of adjusting focal spot positioning including a method of determining position of an electromagnetic radiation source component and a method of operating an electromagnetic source in accordance with an embodiment of the present invention is shown.

In step 150, a method of determining position of an electromagnetic radiation source component is performed. The position may be determined as desired including at sporadic time intervals or continuously depending upon the application and system conditions. In the following example Z-position of the target 42 is determined.

In step 150A, the controller 28 transmits and the probe 50 directs the emission signal 52 at an electromagnetic radiation source component target surface, such as the target 42. The emission signal 52 is directed from the first end 62, incident upon the target 42, and in step 100B is reflected back to the second end 64.

In step 150B, the controller 28 receives the return signal 54, which is in the form of and in response to reflection of the emission signal 52 on the target 42.

In step 150C, the controller 28 upon receiving the return signal 54 determines position of the electromagnetic radiation source component. Continuing the example from above, the controller 28 determines the Z-position of the target 42, which is approximately equal to position of the focal spot 46.

In step 152A, the controller 28 may apply the determined actual focal spot position in performing a back-projection algorithm for CT image reconstruction, compare the actual focal spot position to a desired focal spot position for focal spot adjustment, a combination thereof, or apply the determined actual focal spot position in other applications known in the art.

In step 152B, when the actual focal spot position is compared to a desired focal spot position and the controller 28 determines that the focal spot position is outside a desired focal spot position range, step 104 is performed. Step 154 may also be performed when wobbling the electron beam or for other reasons known in the art.

In step 154, a method of operating the source 18 is operated in response to a difference between the actual focal spot position and the desired focal spot position.

In step 154A, the emitter 74 emits an electron beam 98 from the cathode 38 at the target 42.

In step 154B, the dipole field 97 is generated between the emitter 74 and the anode 44.

In step 154C, the electron beam 98 is interacted with the dipole field 97 and differential bias of the cathode 38 or cathode 110.

In step 154D, the deflection electrodes 82, 116, and 118 are asymmetrically biased to deflect the electron beam and adjust position of the focal spot.

In step 154E, the dipole field 97 and the asymmetrical biasing of the deflection electrodes 82, 116, and 118 may be further modified to alter size and shape of the electron beam 98 and position of the focal spot 46. Upon completion of step 154E the controller 28 may return to step 150.

The above-described steps are meant to be an illustrative example; the steps may be performed synchronously or in a different order depending upon the application.

The present invention provides a focal spot adjusting system that is capable of shifting an electron beam electronically without any mechanically moving components, therefore minimizing on weight of the tube assembly and allowing for increased gantry rotational speeds while at the same time having focal spot adjusting capabilities. The present invention is also capable of determining an actual focal spot position whenever desired to account for various condition and system variations and provide accurate focal spot position determination for enhanced quality image reconstruction.

The above-described apparatus and method, to one skilled in the art, is capable of being adapted for various applications and systems known in the art. The above-described invention can also be varied without deviating from the true scope of the invention.

What is claimed is:

1. A cathode for an imaging tube comprising:

an emitter emitting an electron beam to a focal spot on an anode;

an aperture;

a backing member differentially biased relative to said aperture, electrically disposed on a second side of said emitter, and contributing in formation of said electron beam; and at least one deflection electrode pair electrically disposed between said backing member and said anode and adjusting positioning of said focal spot on said anode.

2. The cathode as in claim 1 further comprising a front member electrically coupled between a first side of said emitter and said anodes, comprising said aperture, and contributing in formation of said electron beam.

3. The cathode as in claim 1 wherein said at least one deflection electrode pair is electrically disposed between a front member and said backing member.

4. The cathode as in claim 1 wherein said at least one deflection electrode pair is electrically disposed between said emitter and a front member.

5. The cathode as in claim 1 further comprising a plurality of insulators coupled between said backing member and a front member and isolating at least one component of the cathode.

6. The cathode as in claim 1 wherein the cathode is mechanically symmetrical.

7. The cathode as in claim 1 wherein said at least one deflection electrode pair is biased to cause said electron beam to be asymmetrically extracted from said emitter.

8. The cathode as in claim 1 wherein said at least one deflection electrode pair form an electron beam passage area therebetween.

9. The cathode as in claim 1 wherein said at least one deflection electrode pair form said aperture.

10. The cathode as in claim 1 wherein said at least one deflection electrode pair comprises:

a first side steering electrode electrically disposed on a first side of an emitter centerline; and a second side steering electrode electrically disposed on a second side of an emitter centerline.

11. The cathode as in claim 3 comprising:

a first side steering electrode insulator coupled between said first side steering electrode and said backing member and isolating said first side steering electrode; and a second side steering electrode insulator coupled between said second side steering electrode and said backing member and isolating said second side steering electrode.

12. A cathode for an imaging tube comprising:

an emitter emitting an electron beam to a focal spot on an anode;

a backing member electrically disposed on a second side of said emitter contributing in formation of said electron beam; and at least one deflection electrode pair electrically disposed between said backing member and said anode and adjusting positioning of said focal spot on said anode;

said at least one deflection electrode pair and said backing member are biased to cause current of said electron beam to be modulated.

13. A cathode for an imaging tube comprising:

an emitter emitting an electron beam to a focal spot on an anode;

a backing member electrically disposed on a second side of said emitter contributing in formation of said electron beam; and at least one deflection electrode pair electrically disposed between said backing member and said anode and adjusting positioning of said focal spot on said anode;

said at least one deflection electrode pair and backing member are biased to cause current of said electron beam to be cut off.

14. A cathode for an imaging tube comprising:

an emitter emitting an electron beam to a focal spot on an anode;

a backing member electrically disposed on a second side of said emitter contributing in formation of said electron beam; and at least one deflection electrode pair electrically disposed between said backing member and said anode and adjusting positioning of said focal spot on said anode;

said at least one deflection electrode pair comprises:

a first pair of deflection electrodes; and a second pair of deflection electrodes.

15. The cathode as in claim 14 wherein said first pair of deflection electrodes adjusts position in width direction and width of said focal spot.

16. The cathode as in claim 14 wherein said second pair of deflection electrodes adjusts position in length direction and length of said focal spot.

17. A method of operating an electromagnetic source comprising:

emitting an electron beam from a differentially biased cathode having an aperture that is differentially biased relative to a backing member;

generating a dipole field;

interacting said electron beam with said dipole field and differential bias of said differentially biased cathode; and asymmetrically biasing said electron beam.

18. The method as in claim 17 further comprising modifying said dipole field.

19. The method as in claim 17 further comprising modifying said asymmetrical biasing of said electron beam.

* * * * *